US012540516B2

(12) United States Patent
Shirley et al.

(10) Patent No.: US 12,540,516 B2
(45) Date of Patent: Feb. 3, 2026

(54) SHORT WELLHEAD SYSTEM FOR A MINERAL EXTRACTION SYSTEM

(71) Applicant: Cameron International Corporation, Houston, TX (US)

(72) Inventors: Brandon Blake Shirley, Houston, TX (US); Dennis P. Nguyen, Houston, TX (US)

(73) Assignee: Cameron International Corporation, Houston, TX (US)

( * ) Notice: Subject to any disclaimer, the term of this patent is extended or adjusted under 35 U.S.C. 154(b) by 71 days.

(21) Appl. No.: 18/743,145

(22) Filed: Jun. 14, 2024

(65) Prior Publication Data

US 2025/0382850 A1 Dec. 18, 2025

(51) Int. Cl.

| | |
|---|---|
| ***E21B 33/04*** | (2006.01) |
| ***E21B 19/08*** | (2006.01) |
| ***E21B 19/16*** | (2006.01) |
| ***E21B 33/06*** | (2006.01) |
| ***E21B 43/10*** | (2006.01) |

(52) U.S. Cl.

CPC ..... *E21B 19/16* (2013.01); *E21B 19/08* (2013.01); *E21B 33/0415* (2013.01); *E21B 33/06* (2013.01); *E21B 43/10* (2013.01)

(58) Field of Classification Search

CPC ..... E21B 33/04; E21B 33/0415; E21B 43/10

See application file for complete search history.

(56) References Cited

U.S. PATENT DOCUMENTS

| | | | | |
|---|---|---|---|---|
| 4,751,965 | A * | 6/1988 | Cassity | E21B 33/04 166/182 |
| 5,327,965 | A * | 7/1994 | Stephen | E21B 33/04 166/182 |
| 5,439,061 | A * | 8/1995 | Brammer | E21B 33/043 166/368 |
| 2008/0308278 | A1* | 12/2008 | Adamek | E21B 33/043 166/348 |
| 2012/0024542 | A1* | 2/2012 | Keat | E21B 33/04 166/88.1 |
| 2014/0311753 | A1* | 10/2014 | Hanson | E21B 33/14 166/208 |
| 2016/0032674 | A1* | 2/2016 | Nguyen | E21B 33/04 166/85.3 |
| 2018/0100368 | A1* | 4/2018 | Nguyen | E21B 33/04 |
| 2018/0171733 | A1* | 6/2018 | Nguyen | E21B 33/04 |
| 2018/0179839 | A1* | 6/2018 | Nguyen | E21B 33/0415 |
| 2018/0347308 | A1* | 12/2018 | Burke | E21B 43/10 |
| 2024/0426188 | A1* | 12/2024 | Nguyen | E21B 33/04 |

* cited by examiner

*Primary Examiner* — Shane Bomar
(74) *Attorney, Agent, or Firm* — Jeffrey D. Frantz

(57) ABSTRACT

A hanger running assembly for a wellhead includes a hanger to support a casing. The hanger running assembly also includes a seal assembly with a push ring and a seal body to support one or more seal elements. The hanger running assembly further includes a torque tool coupled to the push ring via one or more shear pins, wherein rotation of the torque tool in a first direction while the one or more shear pins are intact causes rotation of the push ring in the first direction to thread onto the hanger.

19 Claims, 7 Drawing Sheets

SHORT WELLHEAD SYSTEM FOR A MINERAL EXTRACTION SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity. Once a desired natural resource is discovered below a surface of the earth, mineral extraction systems are often employed to access and extract the desired natural resource. The mineral extraction systems may be located onshore or offshore depending on the location of the desired natural resource. The mineral extraction systems generally include a wellhead through which the desired natural resource is extracted. The wellhead may include or be coupled to a wide variety of components, such as a tubing hanger that supports a tubing, a casing hanger that supports a casing, valves, fluid conduits, and the like.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a hanger running assembly for a wellhead includes a hanger to support a casing. The hanger running assembly also includes a seal assembly with a push ring and a seal body to support one or more seal elements. The hanger running assembly further includes a torque tool coupled to the push ring via one or more shear pins, wherein rotation of the torque tool in a first direction while the one or more shear pins are intact causes rotation of the push ring in the first direction to thread onto the hanger.

In certain embodiments, a wellhead system includes a wellhead housing portion and a hanger running assembly. The hanger running assembly includes a hanger configured to land on a shoulder of the wellhead housing portion and to support a casing. The hanger running assembly also includes a seal assembly with a push ring and a seal body to support one or more seal elements. The hanger running assembly further includes a torque tool coupled to the push ring via one or more shear pins. The hanger running assembly further includes a running tool coupled to the torque tool via one or more keys, wherein rotation of the running tool in a first direction while the one or more shear pins are intact causes the running tool to unthread from the hanger and causes the push ring to thread onto the hanger.

In certain embodiments, a method of constructing a wellhead system includes coupling a push ring to a seal body that supports one or more seal elements, coupling the push ring to a torque tool, and rotating the torque tool in a first direction to cause the push ring to rotate in the first direction to thread the push ring onto a hanger via a first threaded interface.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure generally relate to a short wellhead system. The short wellhead system may include multiple components, such as a hanger, a seal assembly, a push ring, a torque tool, and a running tool, that fit within a blowout preventer (BOP) stack (e.g., diverter) to facilitate efficient casing installation operations. Advantageously, the short wellhead system may be compact in an axial direction, which may enable use of the short wellhead system in certain environments and/or provide reduced materials and costs, for example.

Certain embodiments of the present disclosure include one or more passages formed in (e.g., through or along) a wellhead housing and/or the hanger that supports the casing. The one or more passages are selectively sealed via the seal assembly. Thus, the seal assembly may selectively enable or block a flow of fluid across the hanger (e.g., axially across the hanger). In particular, during cementing operations, the seal assembly may be positioned to enable the flow of fluid through the one or more passages. Then, after the cementing operations, the seal assembly may be positioned to block the flow of fluid through the one or more passages (e.g., to seal the one or more passages). Advantageously, this configuration enables the seal assembly to run with the hanger into the wellhead (e.g., rather than running the hanger into the wellhead, then conducting cementing operations, and then running the seal assembly into the wellhead). However, it should be appreciated that the short wellhead system may be implemented in the wellhead having any of a variety of configurations.

Figure 1:
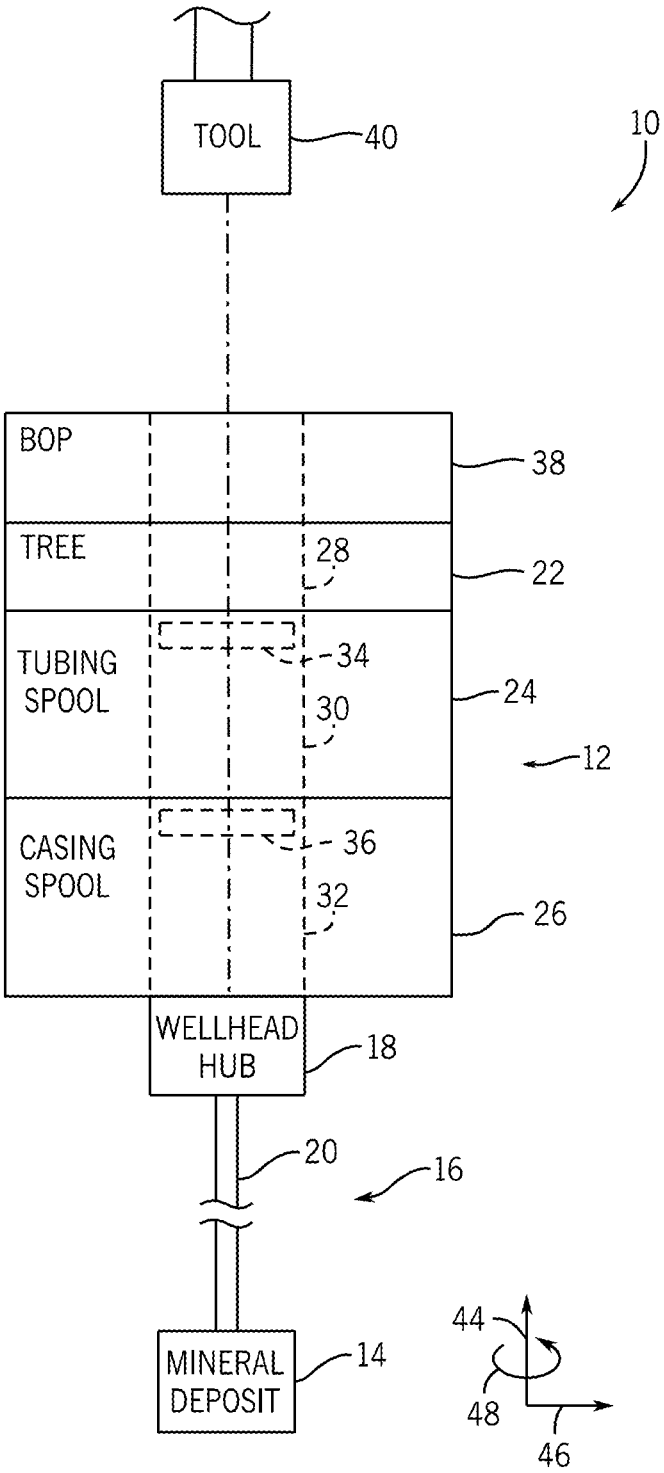
FIG. 1 is a block diagram of a mineral extraction system, in accordance with an embodiment of the present disclosure.

With the foregoing in mind, FIG. 1 is a block diagram of an embodiment of a mineral extraction system 10. The mineral extraction system 10 may be utilized to access and/or extract various natural resources (e.g., hydrocarbons, such as oil and/or natural gas) from the earth. As illustrated, the mineral extraction system 10 includes a wellhead 12 (e.g., annular wellhead) coupled to a mineral deposit 14 via a well 16. The well 16 may include a wellhead hub 18 (e.g., annular wellhead hub) and a wellbore 20. The wellhead hub 18 generally includes a large diameter hub disposed at an end of the wellbore 20 and is configured to connect the wellhead 12 to the wellbore 20. As will be appreciated, the wellbore 20 may contain elevated pressures. For example, the wellbore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16.

In the illustrated embodiment, the mineral extraction system 10 includes a tree 22, a tubing spool 24, a casing spool 26, and a blowout preventer (BOP) 38. The tree 22 generally includes a variety of flow paths (e.g., bores), valves, fittings, and controls for operating the well 16. Further, the tree 22 may provide fluid communication with the well 16. For example, the tree 22 includes a tree bore 28 that provides for completion and workover procedures, such as the insertion of tools (e.g., a tool 40) into the well 16, the injection of various chemicals into the well 16, and so forth. Further, the natural resources extracted from the well 16 may be regulated and routed via the tree 22. For example, the tree 22 may be coupled to a flowline that is tied back to other components, such as a manifold.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the wellbore 20 for various completion and workover procedures. The BOP 38 may consist of a variety of valves, fittings, and controls to block oil, gas, or other fluid from exiting the well 16 in the event of an unintentional release of pressure or an overpressure condition.

As shown, a tubing hanger 34 is positioned within the tubing spool 24. The tubing hanger 34 may be configured to support tubing (e.g., a tubing string) that is suspended in the wellbore 20 and/or to provide a path for control lines, hydraulic control fluid, chemical injections, and so forth. Additionally, as shown, a casing hanger 36 is positioned within the casing spool 26. The casing hanger 36 may be configured to support casing (e.g., a casing string) that is suspended in the wellbore 20. The tool 40 may be utilized to lower the tubing hanger 34 into the tubing spool 24 and/or the casing hanger 36 into the casing spool 26. To facilitate discussion, the mineral extraction system 10, and the components therein, may be described with reference to an axial axis or direction 44, a radial axis or direction 46, and a circumferential axis or direction 48. As discussed in more detail herein, the wellhead 12 may include a short wellhead system that is compact in the axial direction 44 and also facilitates efficient installation operations.

Figure 2:
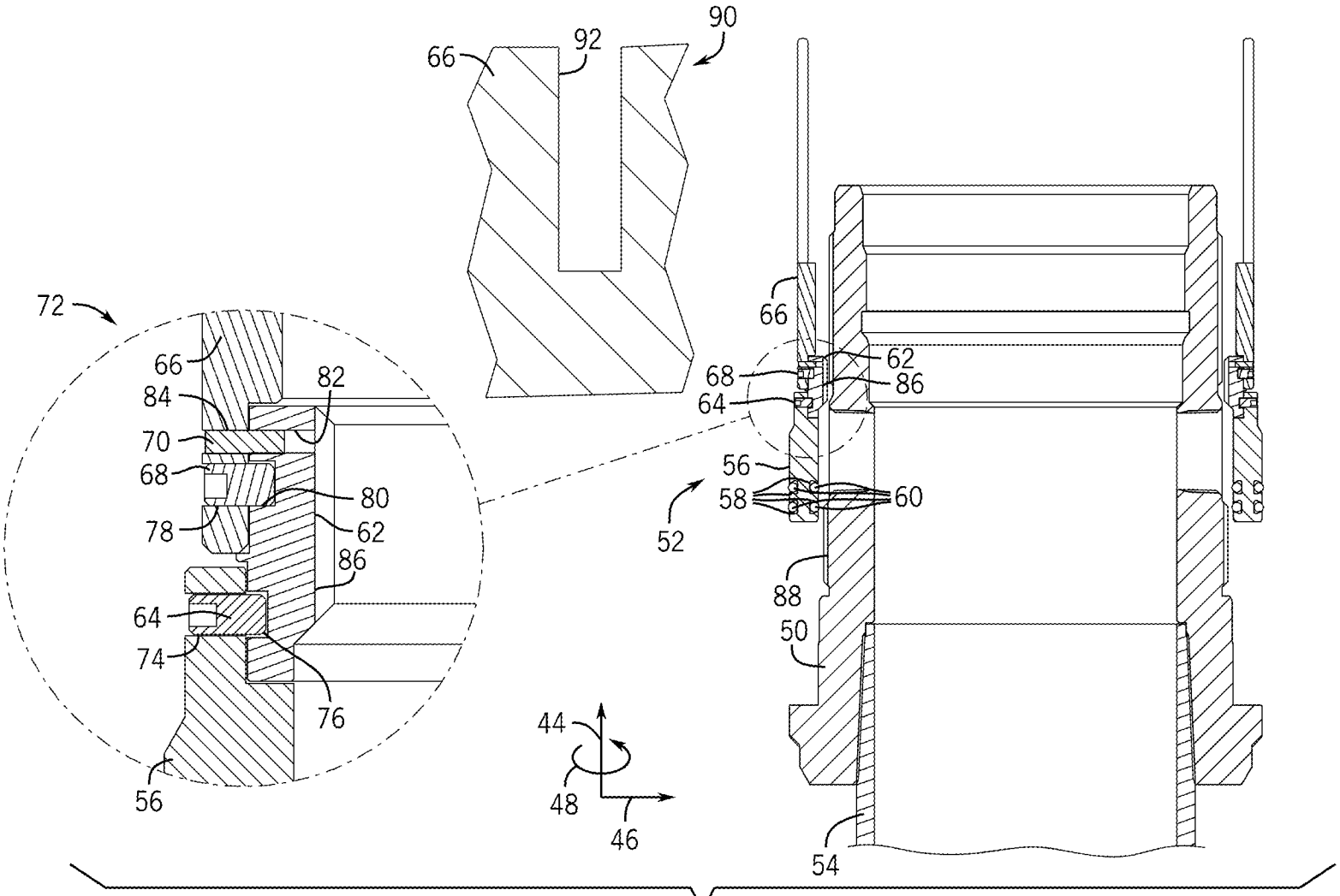
FIG. 2 is a cross-sectional side view of an embodiment of a hanger and a seal assembly that may be utilized in the mineral extraction system of FIG. 1.

FIG. 2 is a cross-sectional side view of an embodiment of a hanger 50 (e.g., annular hanger; a casing hanger, such as the casing hanger 36 of FIG. 1) and a seal assembly 52 (e.g., annular seal assembly) that may be utilized in the mineral extraction system 10 of FIG. 1. In particular, the seal assembly 52 may be positioned about a portion of the hanger 50. As shown, the hanger 50 may support (e.g., suspend) a casing 54 (e.g., annular casing).

The seal assembly 52 may include a seal body 56 (e.g., annular seal body; ring; a one-piece, solid body) that defines one or more seal grooves 58 (e.g., annular seal grooves) that support one or more seal elements 60 (e.g., annular seal elements). The seal assembly 52 may also include a push ring 62 (e.g., annular push ring) that is coupled to the seal body 56 via one or more seal body set screws 64. The seal assembly 52 may also include or be operated via a torque tool 66 (e.g., annular torque tool) that is coupled to the push ring 62 via one or more torque tool set screws 68 and one or more shear pins 70.

As shown in an inset 72 provided in FIG. 2, the seal body 56 may include one or more seal body openings 74, and each of the one or more seal body set screws 64 may be threaded into a respective one of the one or more seal body openings 74. Further, each of the one or more seal body set screws 64 may extend radially into a first groove 76 (e.g., annular groove) formed in a radially outer surface of the push ring 62. Additionally, the torque tool 66 may include one or more torque tool openings 78, and each of the one or more torque tool set screws 68 may be threaded into a respective one of the one or more torque tool openings 78. Further, each of the one or more torque tool set screws 68 may extend radially into a second groove 80 (e.g., annular groove) formed in a radially outer surface of the push ring 62.

Additionally, as shown in the inset 72 provided in FIG. 2, the one or more shear pins 70 extend radially between one or more first shear pin openings 82 (e.g., opening or recess) formed in the push ring 62 and one or more second shear pin openings 84 (e.g., opening or recess) formed in the torque tool 66. In particular, each of the one or more shear pins 70 is positioned within a respective one of the one or more first shear pin openings 82 and a respective one of the one or more second shear pin openings 84.

As described herein, the one or more shear pins 70 enable rotation of the torque tool 66 to drive or cause rotation of the push ring 62 (e.g., the torque tool 66 and the push ring 62 rotate together while the one or more shear pins 70 are intact). The push ring 62 may include a threaded surface 86 (e.g., radially inner surface) that is configured to engage a corresponding threaded surface 88 (e.g., radially outer surface) of the hanger 50. Thus, the rotation of the torque tool 66 and resulting rotation of the push ring 62 also causes the push ring 62 to threadably couple to the hanger 50 (e.g., thread on to the hanger 50; threaded interface). Further, due to placement of the one or more seal body set screws 64, the rotation of the torque tool 66 and resulting rotation of the push ring 62 also causes the seal body 56 to move along the axial axis 44 (e.g., relative to the hanger 50; without rotation of the seal body 56). As shown in an additional inset 90 in FIG. 2, the torque tool 66 also includes one or more axial slots 92 that extend along the axial axis 44. For example, the torque tool 66 may include multiple axial slots 92 that are spaced apart about the circumferential axis 48.

Figure 3:
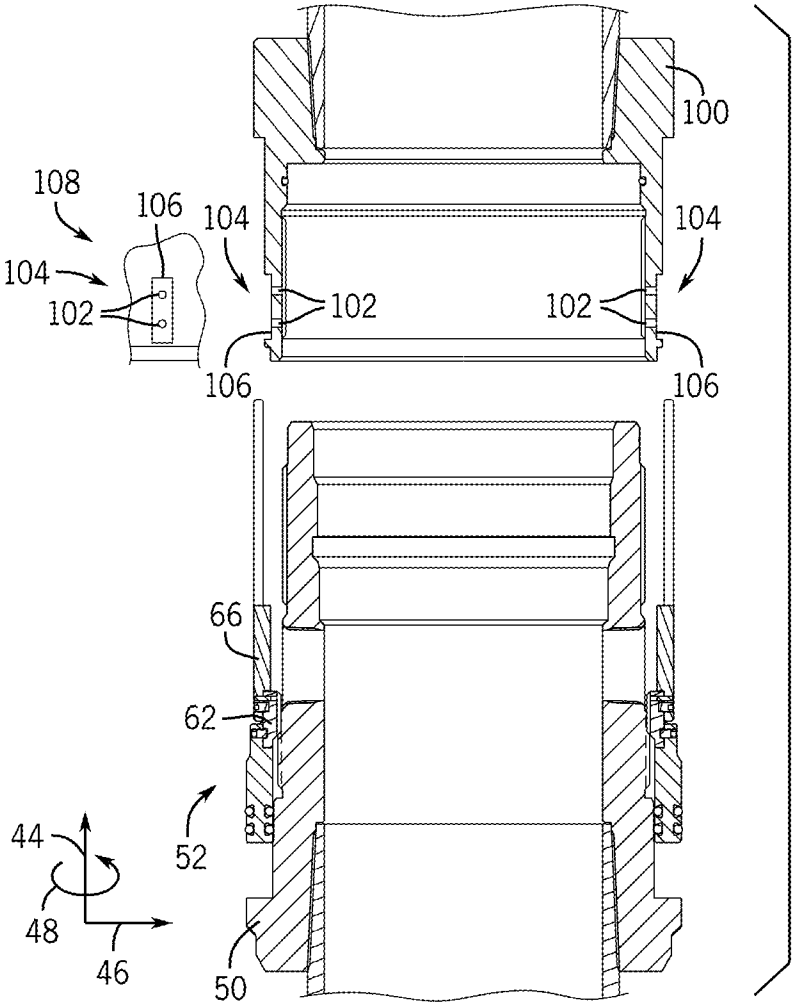
FIG. 3 is a cross-sectional side view of an embodiment of a running tool that is used to engage a torque tool to lower the hanger and the seal assembly into a wellhead of the mineral extraction system of FIG. 1.

FIG. 3 is a cross-sectional side view of an embodiment of a running tool 100 (e.g., annular running tool) that is used to engage the torque tool 66 to lower the hanger 50 and the seal assembly 52 into the wellhead 12 of the mineral extraction system 10 of FIG. 1. As shown, the running tool 100 includes one or more key openings 102 (e.g., grooves or recesses), which may be arranged in sets 104 (e.g., axially-stacked sets) that are spaced apart about the circumferential axis 48. For example, one set 104 of two key openings 102 may be at one location about the circumferential axis 48, and another set 104 of two key openings 102 may be at another location about the circumferential axis 48. It should be appreciated that each set 104 may include any suitable number of key openings 102 (e.g., 1, 2, 3, 4, or more) and any suitable number of sets 104 may be provided about the circumferential axis 48. In certain embodiments, each of the sets 104 is surrounded by or associated with a respective recess 106 formed in a radially outer surface of the running tool 100. An inset 108 of FIG. 3 illustrates an example of one set 104 of two key openings 102, as well as a respective recess 106, that may be formed in the running tool 100.

Figure 4:
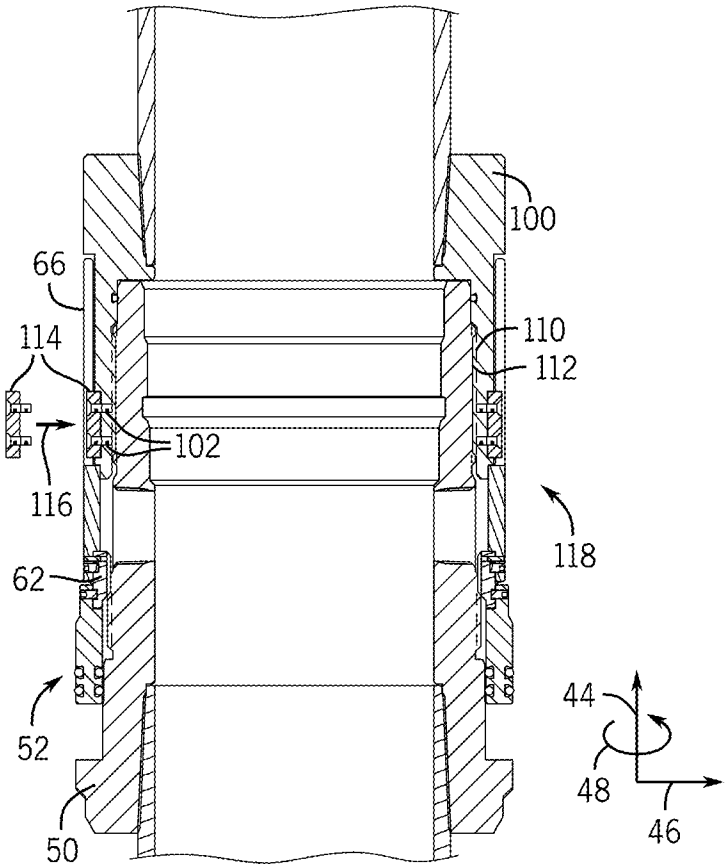
FIG. 4 is a cross-sectional side view of an embodiment of the running tool engaged with the torque tool to enable the running tool to lower the hanger and the seal assembly into the wellhead of the mineral extraction system of FIG. 1.

FIG. 4 is a cross-sectional side view of an embodiment of the running tool 100 engaged with the torque tool 66 to enable the running tool 100 to lower the hanger 50 and the seal assembly 52 into the wellhead 12 of the mineral extraction system 10 of FIG. 1. As shown, a portion (e.g., distal portion) of the running tool 100 is inserted into or received within an annular space defined between the hanger 50 and the torque tool 66. In certain embodiments, the running tool 100 includes a threaded surface 110 (e.g., radially inner surface) that is configured to engage a corresponding threaded surface 112 (e.g., radially outer surface) of the hanger 50. Thus, the rotation of the running tool 100 causes the running tool 100 to threadably couple to the hanger 50 (e.g., thread on to the hanger 50; threaded interface).

Additionally, one or more keys 114 are inserted radially through the one or more axial slots 92 of the torque tool 66 and into the one or more key openings 102 formed in the running tool 100 (e.g., while the one or more axial slots 92 and the one or more key openings 102 are aligned along the circumferential axis 48). For example, the one or more keys 114 may be inserted radially through the one or more axial slots 92 of the torque tool 66 and into the one or more key openings 102 formed in the running tool 100 after the running tool 100 is threaded on to the hanger 50, as shown by arrow 116.

It should be appreciated that the corresponding threaded surface 88 of the hanger 50 that threadably couples to the push ring 62 may be a first direction thread (e.g., right hand thread; threaded interface) and the corresponding threaded surface 112 of the hanger 50 that couples to the running tool 100 may be a second direction thread (e.g., left hand thread; opposite the first direction thread; threaded interface). Additionally, as shown in FIGS. 2-3, the push ring 62 may be threaded at least partially onto the hanger 50 prior to coupling the running tool 100 to the hanger 50. Together, the hanger 50 with the casing 54; the seal assembly 52 with the seal body 56, the push ring 62, the torque tool 66, and other associated components; and the running tool 100 with the key 114 may be considered to form a hanger running assembly 118.

Figure 5:
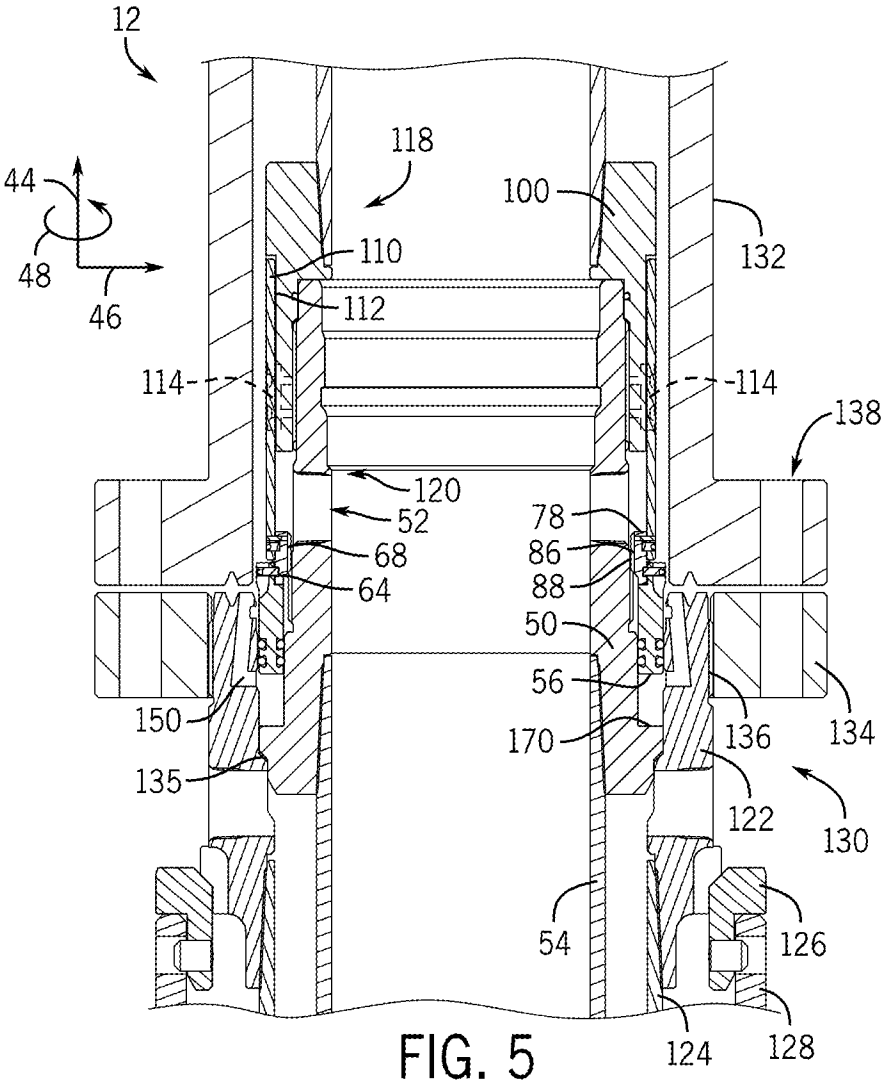
FIG. 5 is cross-sectional side view of an embodiment of the hanger and the seal assembly within the wellhead of the mineral extraction system of FIG. 1, wherein the seal assembly is in a first position.

FIG. 5 is cross-sectional side view of an embodiment of the hanger 50 and the seal assembly 52 within the wellhead 12 of the mineral extraction system 10 of FIG. 1, wherein the seal assembly 52 is in a first position 120 (e.g., unsealed position). In operation, the running tool 100 may run (e.g., lower) the hanger running assembly 118 into a wellhead housing portion 122. In FIG. 5, the wellhead housing portion 122 supports an additional casing 124, and the wellhead housing portion 122 is supported on a conductor housing portion 126 that supports a conductor 128. Together, the wellhead housing portion 122, the conductor housing portion 126, and/or the hanger 50 may be considered to form a wellhead housing 130.

As shown in FIG. 5, the running tool 100 may run the hanger running assembly 118 into the wellhead housing portion 122 while a BOP stack 132 (e.g., diverter) is coupled to the wellhead housing portion 122. For example, a connector 134 (e.g., annular connector or flange) may be threaded onto the wellhead housing portion 122 at a threaded interface 136, and then the BOP stack 132 may be coupled to the connector 134 via one or more fasteners (e.g., bolts) through aligned openings 138 spaced apart about the circumferential axis 48. Components of the hanger running assembly 118 may be sized to insert into and to fit within the BOP stack 132 (e.g., a maximum outer diameter of the hanger running assembly 118 is less than a minimum inner diameter of the BOP stack 132).

The running tool 100 may run the hanger running assembly 118 into the wellhead housing portion 122 until the hanger 50 lands on a shoulder 135 (e.g., annular shoulder) of the wellhead housing portion 122 (e.g., axially facing or radially overlapping surfaces contact one another to block further movement of the hanger 50 relative to the wellhead housing portion 122 toward a wellbore). In certain embodiments, when the hanger 50 lands on the shoulder 135 of the wellhead housing portion 122, the seal body 56 of the seal assembly 52 is positioned radially between the hanger 50 and the wellhead housing portion 122 (e.g., within an annular space defined by the hanger 50 and the wellhead housing portion 122) and at the first position 120 along the axial axis 44.

Further, while the hanger 50 is landed on the shoulder 135 of the wellhead housing portion 122 and while the seal assembly 52 in the first position 120, one or more passageways 150 may be utilized to facilitate cementing operations to cement the casing 54 within the wellbore. In particular, while the hanger 50 is landed on the shoulder 135 and while the seal assembly 52 is in the first position 120, the one or more passageways 150 may enable fluid flow from a first axial location below the hanger 50 to a second axial location above the hanger 50 (e.g., relative to the wellbore). In this way, the one or more passageways 150 enable cement returns to flow from an annular space (e.g., between the casing 54 and the wellhead housing portion 122) at the first axial location below the hanger 50 to the second axial location above the hanger 50. It should be appreciated that the one or more passageways 150 may include one or more openings that extend axially across or through the hanger 50, the wellhead housing portion 122, and/or other unsealed spaces or paths (e.g., an unsealed interface between the hanger 50 and the shoulder 135 of the wellhead housing portion 122; an annular space between the torque tool 66 and the BOP stack 132).

Figure 6:
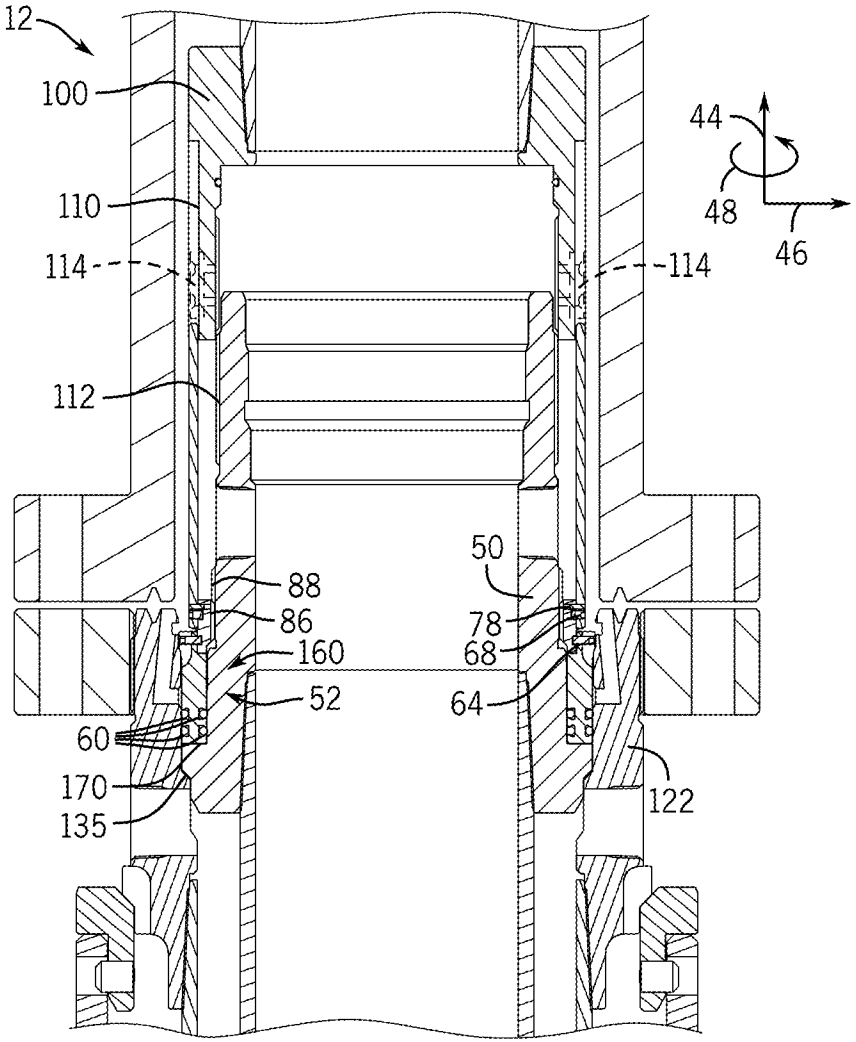
FIG. 6 is cross-sectional side view of an embodiment of the hanger and the seal assembly within the wellhead of the mineral extraction system of FIG. 1, wherein the seal assembly is in a second position.

FIG. 6 is cross-sectional side view of an embodiment of the hanger 50 and the seal assembly 52 within the wellhead 12 of the mineral extraction system of FIG. 1, wherein the seal assembly 52 is in a second position 160 (e.g., sealed position). While the hanger 50 is landed on the shoulder 135 of the wellhead housing portion 122 and while the seal assembly 52 is in the second position 160, the seal assembly 52 provide or form a seal (e.g., annular seal) between the hanger 50 and the wellhead housing portion 122. In particular, the one or more seal elements 60 supported on the seal body 56 provide or form the seal between the hanger 50 and the wellhead housing portion 122. The seal blocks fluid flow through the one or more passageways 150 from the first axial location below the hanger 50 to the second axial location above the hanger 50.

With reference to FIGS. 5 and 6, the seal assembly 52 is moved from the first position 120 of FIG. 5 to the second position 160 of FIG. 6 via rotation of the running tool 100. As one example and as described herein, rotation of the running tool 100 in the second direction (e.g., counter-clockwise) may cause the running tool 100 to thread onto the hanger 50 via engagement between the threaded surface 110 of the running tool 100 and the corresponding threaded surface 112 of the hanger 50. Then, rotation of the running tool 100 in the first direction (e.g., clockwise) unthreads the running tool 100 from the hanger 50 and causes the running tool 100 to move away from the wellbore along the axial axis 44. Due to presence of the one or more keys 114, rotation of the running tool 100 in the first direction drives rotation of the torque tool 66 in the first direction (e.g., the running tool 100 and the torque tool 66 rotate together as long as the one or more keys 114 are positioned within the one or more axial slots 92 (FIG. 2) of the torque tool 66), while also allowing the running tool 100 to move relative to the torque tool 66 along the axial axis 44 (e.g., the one or more keys 114 move within the one or more axial slots 92 along the axial axis 44).

Additionally, due to presence of the one or more shear pins 70, the rotation of the running tool 100 and the rotation of the torque tool 66 drives rotation of the push ring 62 (e.g., the running tool 100, the torque tool 66, and the push ring 62 rotate together as long as the one or more keys 114 are positioned within the one or more axial slots 92 (FIG. 2) of the torque tool 66, and as long as the one or more shear pins 70 are intact). As one example and as described herein, rotation of the push ring 62 in the first direction (e.g., clockwise) may cause the push ring 62 to thread onto the hanger 50 via engagement between the threaded surface 86 of the push ring 62 and the corresponding threaded surface 88 of the hanger 50. Thus, rotation of the running tool 100 in the first direction and resulting rotation of the torque tool 66 and the push ring 62 in the first direction causes the push ring 62 to thread onto to the hanger 50 and to toward the wellbore along the axial axis 44. Accordingly, rotation of the running tool 100 in the first direction drives the running tool 100 and the push ring 62 (along with the seal body 56) away from one another along the axial axis 44. Further, due to placement of the one or more seal body set screws 64 in the first groove 76 formed in the push ring 62, the push ring 62 drives the seal body 56 to move along the axial axis 44 (e.g., relative to the hanger 50; without rotation of the seal body 56).

The push ring 62 may continue to rotate with the torque tool 66 and the running tool 100 until the seal body 56 reaches a stop surface 170 (e.g., annular surface; axial-facing surface) of the hanger 50. Then, further rotation of the torque tool 66 and the running tool 100 causes the one or more shear pins 70 to break (e.g., shear). Then, after the one or more shear pins 70 break, further rotation of the torque tool 66 and the running tool 100 no longer causes rotation of the push ring 62. Instead, further rotation of the torque tool 66 and the running tool 100 may cause the one or more torque tool set screws 68 to move circumferentially about the push ring 62 via the second groove 80 formed in the push ring 62.

Eventually, further rotation of the running tool 100 causes the running tool 100 to separate from the torque tool 66 (e.g., the one or more keys 114 slide out of and withdraw from the one or more axial slots 92 of the torque tool 66) and also to separate from the hanger 50 (e.g., the threads 110 unthread fully from the corresponding threads 112). Then, the running tool 100 may be withdrawn, and the torque tool 66 may remain coupled to the push ring 62 via the one or more torque tool set screws 68.

Figure 7:
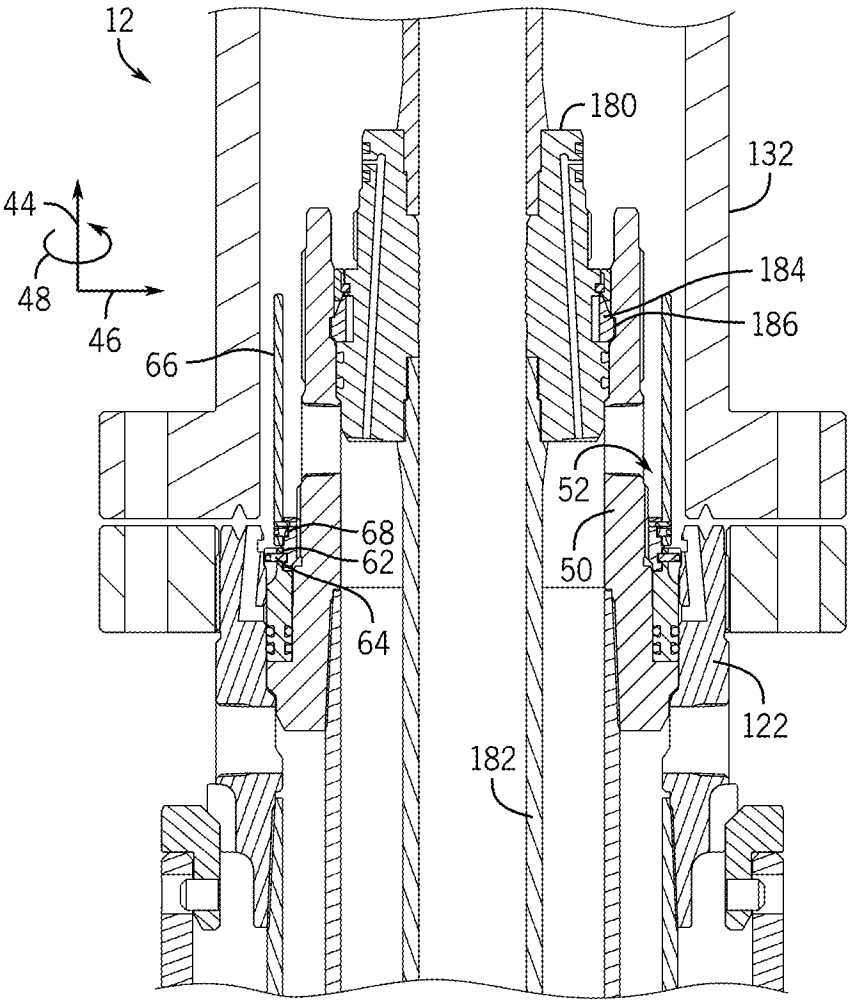
FIG. 7 is cross-sectional side view of an embodiment of the hanger and the seal assembly within the wellhead of the mineral extraction system of FIG. 1, wherein a tubing hanger is coupled to the hanger.

FIG. 7 is cross-sectional side view of an embodiment of the hanger 50 and the seal assembly 52 within the wellhead 12 of the mineral extraction system 10 of FIG. 1, wherein a tubing hanger 180 (e.g., annular hanger; the tubing hanger 34 of FIG. 1) is coupled to the hanger 50. As shown, the tubing hanger 180 supports tubing 182 (e.g., tubing strings) that extends toward the wellbore. The tubing hanger 180 may be set and locked within the hanger 50, such as via a lock ring 184 that engages a corresponding lock ring groove 186 formed in the hanger 50. In certain embodiments, the tubing hanger 180 may be set and locked within the hanger 50 while the BOP stack 132 coupled to the wellhead 12. Further, in certain embodiments, the tubing hanger 180 may be set and locked within the hanger 50 while the torque tool 66 is coupled to the push ring 62 via the one or more torque tool set screws 68.

Figure 8:
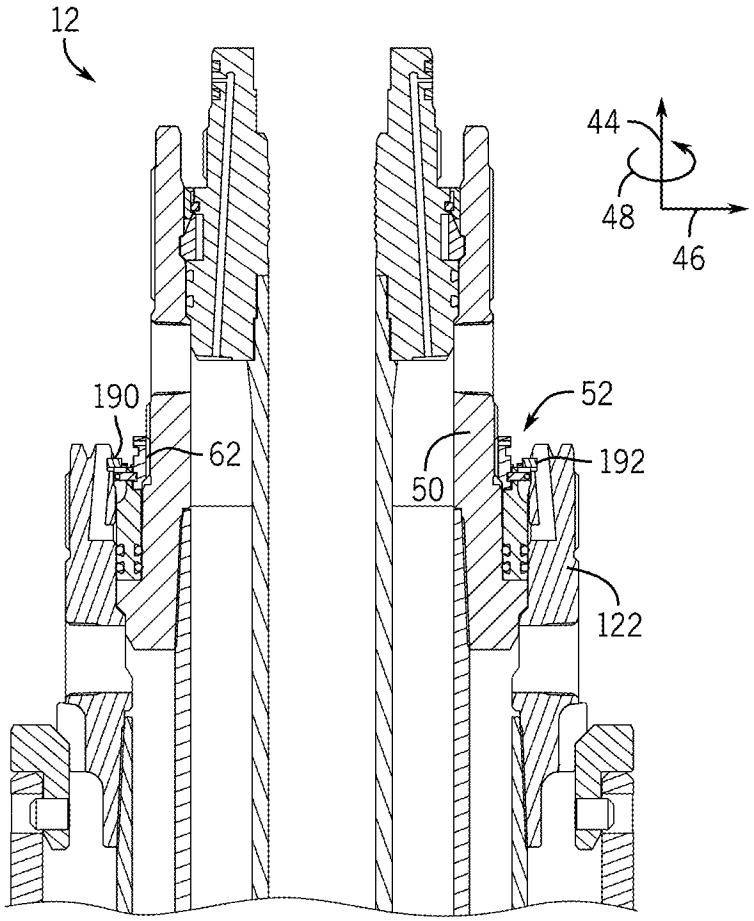
FIG. 8 is cross-sectional side view of an embodiment of the hanger and the seal assembly within the wellhead of the mineral extraction system of FIG. 1, wherein the torque tool is withdrawn.

FIG. 8 is cross-sectional side view of an embodiment of the hanger 50 and the seal assembly 52 within the wellhead 12 of the mineral extraction system of FIG. 1, wherein the torque tool 66 (see, e.g., FIG. 5) is withdrawn. With reference to FIGS. 7 and 8, the torque tool 66 may be withdrawn via removal of the BOP stack 132 to provide access to the one or more torque tool set screws 68. Then, the one or more torque tool set screws 68 may be removed (e.g., manually; via an operator manipulating a removal tool). With the one or more torque tool set screws 68 removed, the torque tool 66 may be separated from the push ring 62 and withdrawn from the wellhead 12. In certain embodiments, the threaded interface between the push ring 62 and the hanger 50, along with the one or more seal body set screws 64, and/or contacting surfaces between the push ring 62 and the seal body 56 may support retention of the components of the seal assembly 52 in the wellhead 12 (e.g., between the hanger 50 and the wellhead housing portion 122). In certain embodiments, a retainer 190 (e.g., annular retainer ring or retainer segments) may be installed (e.g., manually; via an operator placing the retainer 190) to retain the components of the seal assembly 52 in the wellhead 12. For example, the retainer 190 may be inserted into one or more groove portions 192 formed in the wellhead housing portion 122, and the retainer 190 may extend radially inwardly to contact and/or radially overlap with the seal body 56 to retain the components of the seal assembly 52 in the wellhead 12.

Figure 9:
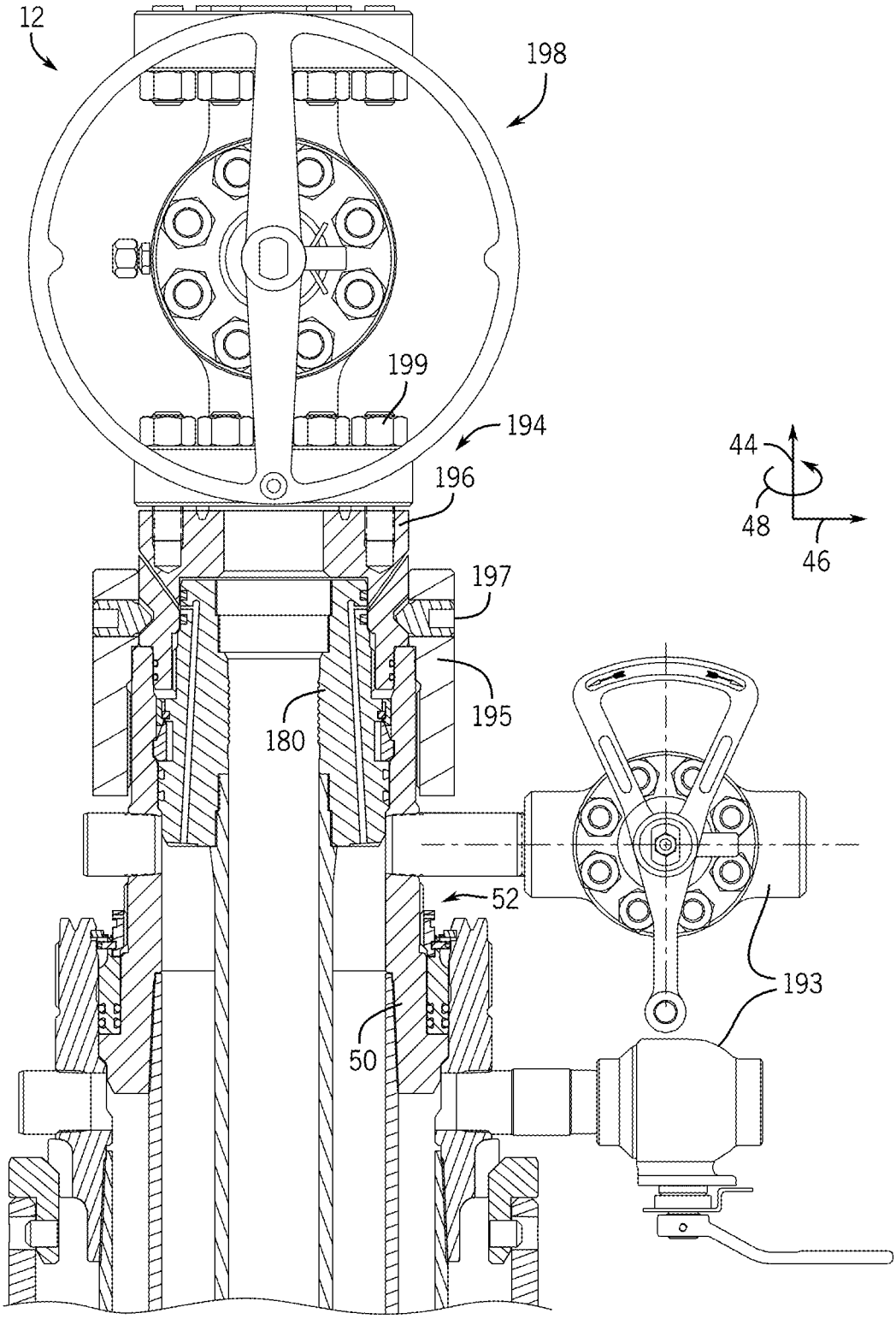
FIG. 9 is cross-sectional side view of an embodiment of the hanger and the seal assembly within the wellhead of the mineral extraction system of FIG. 1, wherein a seal flange adapter is coupled to the tubing hanger.

FIG. 9 is cross-sectional side view of an embodiment of the hanger 50 and the seal assembly 52 within the wellhead 12 of the mineral extraction system 10 of FIG. 1, wherein a seal flange adapter 194 (e.g., annular seal flange adapter) is coupled to the tubing hanger 180. As shown, the seal flange adapter 194 includes a seal flange body 195, a seal flange connector 196, and seal flange pins 197. The seal flange body 195 may threadably couple to the hanger 50 (e.g., threaded interface), and the seal flange pins 197 may couple (e.g., pin) the seal flange body 195 to the seal flange connector 196. Further, the seal flange connector 196 may provide a support (e.g., mount; connection) for one or more additional components 198 (e.g., valves). For example, one or more fasteners 199 may be utilized to couple the seal flange connector 196 to the one or more additional components 198, as shown. In certain embodiments, one or more additional components 193 (e.g., valves) may be coupled to the wellhead 12 other locations, such as along the hanger 50. Advantageously, the wellhead 12 may include or provide a short wellhead system, which may be compact along the axial axis 44. As described herein, the wellhead 12 may include or provide other desirable operational features, such as efficient cementing operations and ability to run the seal assembly 52 with the hanger.

Figure 10:
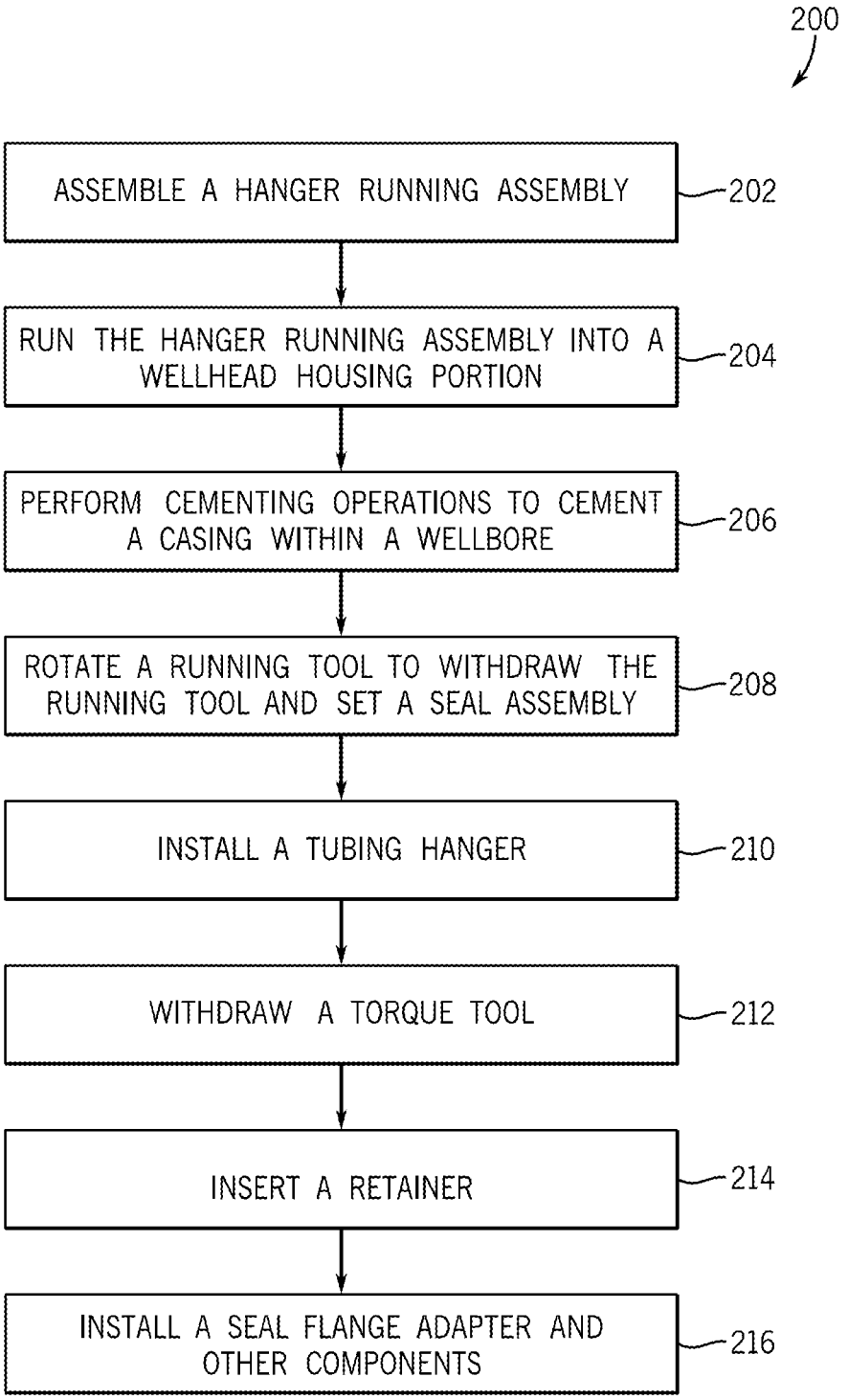
FIG. 10 is a flow diagram of an embodiment of a method of operating a short wellhead system for a mineral extraction system.

FIG. 10 is a flow diagram of an embodiment of a method 200 of operating a short wellhead system (e.g., components of the wellhead 12 of FIG. 1) for a mineral extraction system (e.g., the mineral extraction system 10 of FIG. 1). The method 200 disclosed herein includes various steps represented by blocks. Although the flow chart illustrates the steps in a certain sequence, it should be understood that the steps may be performed in any suitable order and certain steps may be carried out simultaneously, where appropriate.

In block 202, the method 200 may begin with assembling a hanger running assembly. As described herein, the hanger running assembly may include a hanger with a casing; a seal assembly with a seal body, a push ring, a torque tool, and other associated components; and a running tool with one or more keys.

In block 204, the method 200 may continue with running the hanger running assembly into a wellhead, such as through a BOP stack and into wellhead housing portion. For example, running the hanger running assembly into the wellhead may include lowering the hanger running assembly until the hanger lands on a shoulder of the wellhead housing portion.

In block 206, the method 200 may continue with completing cementing operations. As described herein, the cementing operations may be carried out to cement the casing within a wellbore after the hanger is landed on the shoulder of the wellhead housing portion. Further, as described herein, the seal assembly may be run with the hanger or inserted at some other suitable time after the hanger is landed on the shoulder of the wellhead housing portion. In this way, the casing may be cemented in place within the wellbore, and an annular space below the hanger may be sealed and isolated from above the hanger.

In block 208, the method 200 may continue with rotating the running tool to withdraw the running tool and set the seal assembly within the wellhead. As described herein, this rotation of the running tool may cause the running tool to unthread from the hanger (e.g., move away from the wellbore) and also cause the push ring of the seal assembly to thread onto the hanger (e.g., move toward the wellbore), such as due to engagement of the torque tool with the running tool via the one or more keys and engagement of the torque tool with the push ring via one or more shear pins, for example.

In block 210, the method 200 may continue with installing a tubing hanger. In block 212, the method 200 may continue with withdrawing the torque tool. In block 214, the method 200 may continue with inserting a retainer to retain the seal assembly and/or the hanger within the wellhead housing portion. In block 216, the method 200 may continue with installing a seal flange adapter and other components (e.g., valves).

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the invention as defined by the following appended claims. For example, while the illustrated embodiments show a hanger and a housing of a wellhead, it should be understood that the systems and methods may be adapted to for use with any of a variety of other annular structures. Additionally, any features shown or described with reference to FIGS. 1-10 may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A hanger running assembly for a wellhead, the hanger running assembly comprising:

a hanger to support a casing;

a seal assembly comprising a push ring and a seal body to support one or more seal elements; and a torque tool coupled to the push ring via one or more shear pins, wherein rotation of the torque tool in a first direction while the one or more shear pins are intact causes rotation of the push ring in the first direction to thread onto the hanger.

2. The hanger running assembly of claim 1, wherein the push ring is coupled to the seal body via one or more seal body set screws that extend radially through one or more seal body openings in the seal body and into an annular groove formed in the push ring to enable the rotation of the push ring to drive axial movement of the seal body without rotation of the seal body.

3. The hanger running assembly of claim 1, wherein the push ring is coupled to the torque tool via one or more torque tool set screws that extend radially through one or more torque tool openings in the torque tool and into an annular groove formed in the push ring to block axial movement of the torque tool relative to the push ring and to enable the torque tool to rotate independently of the push ring while the one or more shear pins are not intact.

4. The hanger running assembly of claim 1, comprising a running tool, wherein rotation of the running tool in a second direction causes the running tool to thread onto the hanger.

5. The hanger running assembly of claim 4, wherein the running tool is positioned within an annular space defined between the hanger and the torque tool.

6. The hanger running assembly of claim 4, comprising a key configured to couple the torque tool to the running tool.

7. The hanger running assembly of claim 6, wherein rotation of the running tool in the first direction causes the running tool to unthread from the hanger and causes, via the key, rotation of the torque tool in the first direction.

8. The hanger running assembly of claim 6, wherein the torque tool comprises an axial slot, the running tool comprises one or more key openings, and the key is inserted radially through the axial slot and the one or more key openings to couple the torque tool to the running tool.

9. The hanger running assembly of claim 1, wherein the one or more seal elements are configured to seal an annular space between the hanger and a wellhead housing portion.

10. A wellhead system, comprising:

a wellhead housing portion; and a hanger running assembly, comprising:

a hanger configured to land on a shoulder of the wellhead housing portion and to support a casing;

a seal assembly comprising a push ring and a seal body to support one or more seal elements;

a torque tool coupled to the push ring via one or more shear pins; and a running tool coupled to the torque tool via one or more keys;

wherein rotation of the running tool in a first direction while the one or more shear pins are intact causes the running tool to unthread from the hanger and causes the push ring to thread onto the hanger.

11. The wellhead system of claim 10, wherein the torque tool comprises one or more axial slots, the running tool comprises one or more key openings, and the one or more keys are inserted radially through the one or more axial slots and the one or more key openings to couple the torque tool to the running tool.

12. The wellhead system of claim 10, wherein the one or more keys couple the torque tool to the running tool such that the rotation of the running tool in the first direction causes rotation of the torque tool in the first direction.

13. The wellhead system of claim 10, wherein the one or more keys couple the torque tool to the running tool to enable the running tool to move axially relative to the torque tool.

14. The wellhead system of claim 10, wherein, while the one or more shear pins are intact, the rotation of the running tool in the first direction causes the torque tool to move axially with the push ring.

15. The wellhead system of claim 10, comprising a blowout preventer (BOP) stack configured to couple to the wellhead housing portion, wherein the hanger running assembly is positioned within the BOP stack to land the hanger on the shoulder of the wellhead housing portion.

16. A method of constructing a wellhead system, the method comprising:

coupling a push ring to a seal body that supports one or more seal elements;

coupling the push ring to a torque tool;

rotating the torque tool in a first direction to cause the push ring to rotate in the first direction to thread the push ring onto a hanger via a first threaded interface; and coupling the push ring to the torque tool via one or more shear pins, wherein the one or more shear pins are configured to shear in response to the push ring being threaded fully onto the hanger via the first threaded interface.

17. The method of claim 16, comprising:

coupling the push ring to the seal body via one or more set screws that extend radially into an annular groove formed in the push ring.

18. The method of claim 16, comprising:

rotating a running tool in a second direction to thread the running tool onto the hanger via a second threaded interface; and inserting one or more keys radially through one or more axial slots formed in the torque tool and into one or more key openings formed in the running tool to couple the running tool to the torque tool.

19. The method of claim 18, comprising:

rotating the running tool in the first direction to cause the torque tool and the push ring to rotate in the first direction to thread the push ring onto the hanger via the first threaded interface, and to cause the running tool to unthread from the hanger at the second threaded interface.

* * * * *